United States Patent [19]

Ohtsu

[11] Patent Number: 5,052,500

[45] Date of Patent: Oct. 1, 1991

[54] VIBROISOLATING HANDLE JOINT STRUCTURE FOR POWER TOOL

[75] Inventor: Shinki Ohtsu, Ibaraki, Japan

[73] Assignee: Hitachi Koki Company, Limited, Tokyo, Japan

[21] Appl. No.: 478,108

[22] Filed: Feb. 9, 1990

Related U.S. Application Data

[63] Continuation of Ser. No. 344,926, Apr. 28, 1989, Pat. No. 4,936,394.

[30] Foreign Application Priority Data

Apr. 30, 1988 [JP] Japan ..... 63-108092

[51] Int. Cl.[5] ..... B25G 3/00; B25D 17/04

[52] U.S. Cl. ..... 173/162.002; 267/141.007

[58] Field of Search ..... 173/162.2; 267/141.3, 267/137, 141.7

[56] References Cited

U.S. PATENT DOCUMENTS 3,391,892 7/1968 Neidhart et al. ..... 267/141.7
4,630,809 12/1986 Duckworth ..... 267/141.7
4,771,833 9/1988 Honsa ..... 173/162.2

FOREIGN PATENT DOCUMENTS 528384 7/1956 Canada ..... 267/141.7
2138348 10/1984 United Kingdom .

*Primary Examiner*—Douglas D. Watts
*Assistant Examiner*—Scott A. Smith
*Attorney, Agent, or Firm*—Lowe, Price, LeBlanc & Becker

[57] ABSTRACT

A vibroisolating handle joint structure for a power tool such as a disc grinder has a vibratable power tool unit, a tubular handle holder fastened to the power tool unit and having first axial surfaces, a grip handle having on one end thereof a larger-diameter cup disposed radially around the handle holder and having second axial surfaces extending in substantially axially confronting relation to the first axial surfaces, and elastic members disposed between and joined to the first and second axial surfaces. The power tool unit and the handle are thus interconnected by the elastic members in a vibroisolating manner without using metallic plates. Even when some of the elastic members are torn apart, the power tool unit and the handle are prevented from being separated from each other by the first and second axial surfaces which are engageable with each other.

11 Claims, 2 Drawing Sheets

VIBROISOLATING HANDLE JOINT STRUCTURE FOR POWER TOOL

This application is a continuation of application Ser. No. 07/344,926, filed Apr. 28, 1989 new U.S. Pat. No. 4,936,394.

BACKGROUND OF THE INVENTION

1. Field of the Invention

The present invention relates to a vibroisolating handle joint structure for a power tool such as a disc grinder.

2. Description of the Prior Art

Japanese Laid-Open Utility Model Publication No. 47-26382, published Nov. 25, 1972, discloses a powered hand tool such as a disc grinder having a vibroisolating handle joint structure which includes elastic members interposed between a power tool unit and a handle for preventing vibrations from being transmitted from the power tool unit to the hand of the user which grips the handle. Each of the elastic members is made of rubber or the like with two metallic plates fixed to opposite sides of the elastic member by means of screws. One of the metallic plates is fastened to the power tool unit whereas the other metallic plate is fastened to the handle, thus interconnecting the power tool unit and the handle.

Generally, electrically powered hand tools have tool casings and handles which are made of plastics, i.e., an electric insulator, for protecting the user from accidental electric shocks.

The metallic plates in the power tool disclosed in the above publication must also be insulated for safety. Therefore, the disclosed power tool is large in size and heavy in weight because of the insulation needed by the metallic plates, and hence cannot easily be handled in use. Another problem with the conventional power tool is that since the tool and the handle are joined to each other only by the elastic members, the bonding strength between the metallic plates and the elastic members has to be of a predetermined level or higher. It requires a costly, laborious, and time-consuming process to obtain the required bonding strength between the metallic plates and the elastic members.

SUMMARY OF THE INVENTION

It is an object of the present invention to provide a vibroisolating handle joint structure for a power tool, which interconnects a handle and a power tool unit in a vibroisolating fashion without using any metallic plates, and which makes the power tool lightweight, less bulky, and easy to manufacture and handle in use.

Another object of the present invention is to provide a vibroisolating handle joint structure for a power tool, which prevents a handle and a power tool unit from being separated from each other even if elastic members joining the handle and the power tool unit are deteriorated and torn apart, so that the power tool can be used safely.

According to the present invention, there is provided a vibroisolating handle joint structure for a power tool includes a vibratable power tool unit, a tubular handle holder fastened to the power tool unit and having first axial surfaces, a grip handle having on one end thereof a larger-diameter cup disposed radially around the handle holder and having second axial surfaces extending in substantially axially confronting relation to the first axial surfaces, and elastic members disposed between and joined to the first and second axial surfaces.

The tubular handle holder has a radially outwardly projecting flange having the first axial surfaces on axially opposite sides thereof and extending axially between the second axial surfaces, and the larger-diameter cup has recesses defined by the second axial surfaces. Alternatively, the grip handle has recesses defined by the second axial surfaces, and the larger-diameter cup has a radially inwardly projecting flange having the second axial surfaces on axially opposite sides thereof and extending axially between the first axial surfaces.

The above and other objects, features and advantages of the present invention will become more apparent from the following description when taken in conjunction with the accompanying drawings in which preferred embodiments of the present invention are shown by way of illustrative example.

DETAILED DESCRIPTION

Figure 1:
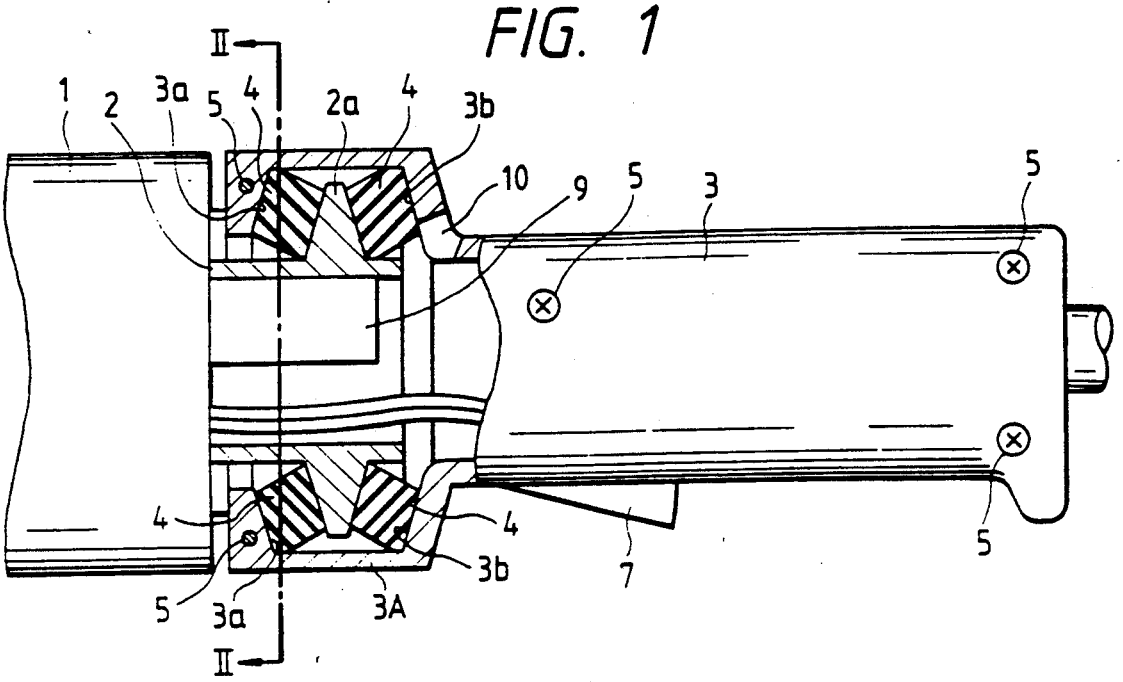
FIG. 1 is a cross-sectional view of a vibroisolating handle joint structure for a power tool according to an embodiment of the present invention.

Like or corresponding parts are denoted by like or corresponding reference numerals throughout views.

Figure 2:
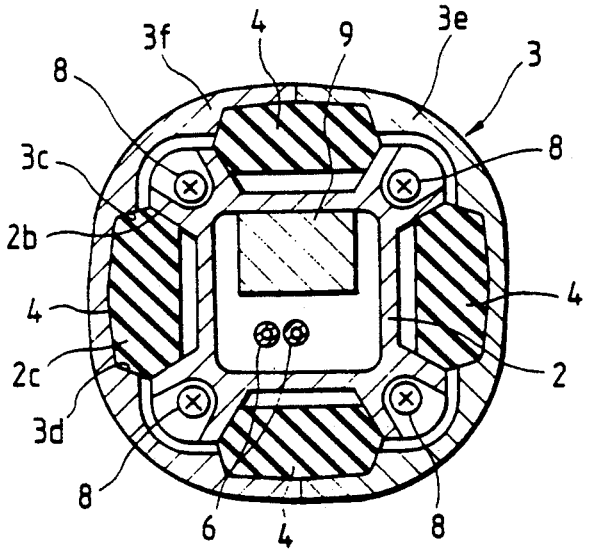
FIG. 2 is a cross-sectional view taken along line II—II of FIG. 1.

FIGS. 1 and 2 show a vibroisolating handle joint structure for a power tool such as a disc grinder or the like. The power tool includes a power tool unit 1 which produces vibrations during use, a tubular handle holder 2 fastened to the power tool unit 1 by means of screws 8, and a grip handle 3 connected to the tubular handle holder 2. The handle holder 2 has a radially outwardly tapered flange 2*a* projecting radially outwardly from a tubular body of the handle holder 2. Two sets of elastic damper members 4, each set being composed of four angularly equally spaced elastic members 4, are disposed one on each axial side of the flange 2*a* around the handle holder 2, the elastic members 4 being made of rubber or any of various other suitable elastomeric materials. The elastic members 4 have axial surfaces joined to the axially opposite surfaces of the flange 2*a* which are slanted with respect to the axes of the handle holder 2 and the handle 3.

The handle 3 has, on one end thereof, a larger diameter cup 3A defining a pair of axially joined recesses 3*a*, 3*b* disposed one on each side of the elastic members 4 and hence the flange 2*a* and positioned radially around the handle holder 2, the recesses 3*a*, 3*b* housing therein the two sets of elastic members 4, respectively. The recesses 3*a*, 3*b* have radially inner ends positioned radially inwardly of the radially outer end of the flange 2*a*. The elastic members 4 have opposite outer axial surfaces joined to the axially confronting slanted inner surfaces of the recesses 3*a*, 3*b*. As shown in FIG. 2, the handle holder 2 has a plurality of sets (four sets in FIG. 2) of two radially outwardly directed surfaces 2*b*, 2*c*, and the handle 3 has a plurality of sets (four sets in FIG. 2) of two radially inwardly directed surfaces 3*c*, 3*d*. The lateral ends of each of the elastic members 4, which face in the circumferential direction around the axis of the handle holder 2, are held against the surfaces 2b, 2c in one set thereof and the surfaces 3c, 3d in the corresponding set thereof for preventing the handle 3 from being angularly displaced with respect to the handle holder 2.

As illustrated in FIG. 2, the handle 3 is composed of two longitudinally separate handle members 3e, 3f. For assembling the handle 3 and the handle holder 2 together, the handle members 3e, 3f are placed around the handle holder 2 and then fastened to each other by means of screws 5 (FIG. 1). Since the handle 3 is composed of the separable handle members 3e, 3f, therefore, the handle 3 can easily be installed on the handle holder 2 by bringing the handle members 3e, 3f radially toward each other over the handle holder 2.

A control box 9 containing an electric control circuit for controlling the speed of rotation of the power tool is mounted in the handle holder 2. The handle 3 has an air hole 10 defined therein just behind the recess 3b for allowing air to be introduced therethrough into the handle holder 2. Therefore, the electric control circuit contained in the control box 9 can effectively be cooled.

When the power tool is energized, the power tool unit 1 is vibrated, but the produced vibrations transmitted from the power tool unit 1 to the handle 3 are effectively dampened by the elastic member 4. Therefore, any vibrations of the handle 3 near a switch 7 mounted therein and gripped by the hand of the user of the power tool are reduced.

The handle holder 2 and the handle 3 are connected to each other by the elastic members 4 disposed between and joined to the flange 2a of the handle holder 2 and the axially opposite surfaces of the recesses 3a, 3b of the handle 3. Consequently, the power tool unit 1 and the handle 3 are supported on each other by the elastic members 4 without using any metallic plates which would otherwise be joined to the elastic members 4.

Even when some or all of the elastic members 4 are deteriorated and torn apart, the power tool unit 1 and the handle 3 are prevented from being separated because the flange 2a of the handle holder 2 fastened to the power tool unit 1 can be engaged by the surfaces of the recesses 3a, 3b against dislodgment from the larger-diameter cup 3A of the handle 3. Accordingly, various troubles such as breakage of electric wires 6 electrically interconnecting the switch 7 and the motor (not shown) in the power tool unit 1 are prevented.

Figure 3:
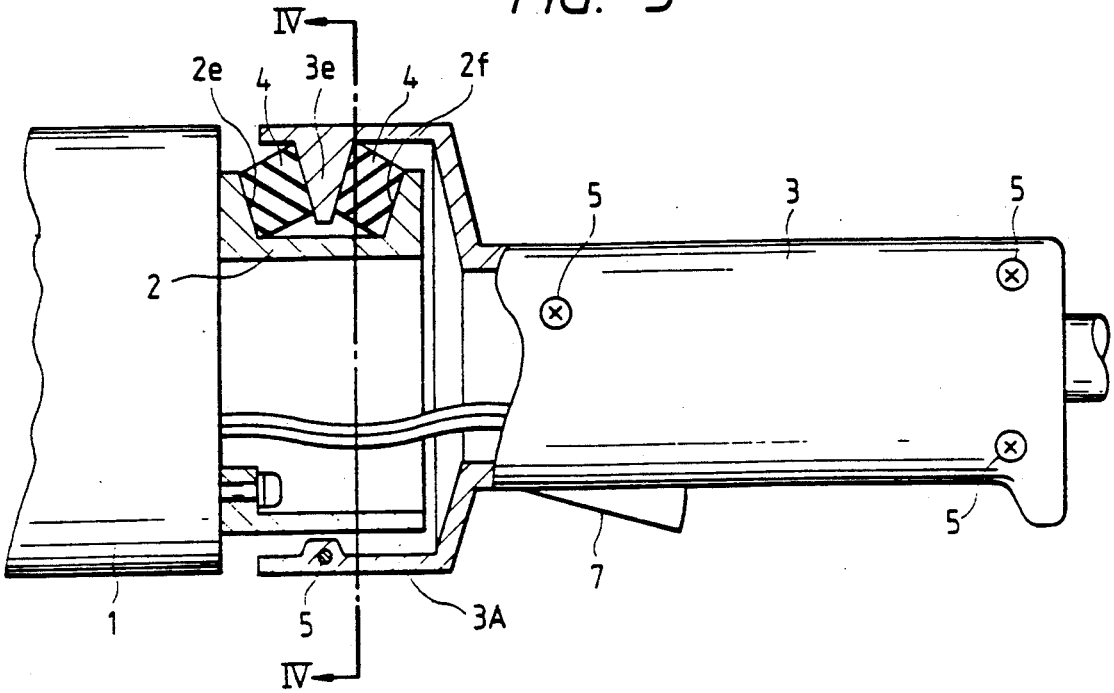
FIG. 3 is a cross-sectional view of a vibroisolating handle joint structure for a power tool according to another embodiment of the present invention, the view being taken along line III—III of FIG. 4.
Figure 4:
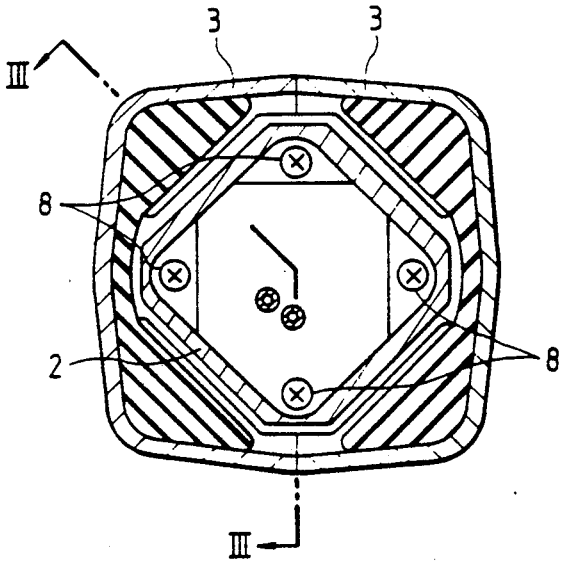
FIG. 4 is a cross-sectional view taken along line IV—IV of FIG. 3.

FIGS. 3 and 4 illustrate a vibroisolating handle joint structure for a power tool in accordance with another embodiment of the present invention.

According to this embodiment, a handle holder 2 fastened to a power tool unit 1 has radially outwardly opening recesses 2e, 2f which are axially joined to each other, and a handle 3 has a radially inwardly tapered flange 3e projecting radially inwardly from a larger-diameter cup 3A disposed on one end of the handle 3 and extending radially around the handle holder 2. Two sets of elastic members 4, one set composed of two diametrically opposite elastic members 4, are disposed in the respective recesses 2e, 2f. The elastic members 4 have axial surfaces joined to the opposite axial slanted sides of the flange 3e, and other axial surfaces joined to the confronting axial slanted sides of the recesses 2e, 2f.

Although certain preferred embodiments have been shown and described, it should be understood that many changes and modifications may be made therein without departing from the scope of the appended claims.

What is claimed is:

1. A vibroisolating handle joint structure for a power tool, comprising a vibratable power tool unit;

a tubular handle holder fastened to said power tool unit and having first axial surfaces;

a grip handle having on one end thereof a larger-diameter cup disposed radially around said handle holder and having second axial surfaces extending in substantially axially confronting relationship to said first axial surfaces; and at least one pair of resilient means aligned parallel to the axis of said handle with each pair member of resilient means being positioned between different surfaces of both said grip handle and said tubular handle holder.

2. A vibroisolating handle joint structure according to claim 1, wherein said tubular handle holder has a radially outwardly projecting flange having said first axial surfaces on axially opposite sides thereof and extending axially between said second axial surfaces, and said larger-diameter cup has recesses defined by said second axial surfaces.

3. A vibroisolating handle joint structure according to claim 2, wherein said first and second axial surfaces are slated with respect to axes of said tubular handle holder and said grip handle.

4. A vibroisolating handle joint structure according to claim 1, wherein said grip handle has recesses defined by said second axial surfaces, and said larger-diameter cup has a radially inwardly projecting flange having said second axial surfaces on axially opposite sides thereof and extending axially between said first axial surfaces.

5. A vibroisolating handle joint structure according to claim 4, wherein said first and second axial surfaces are slanted with respect to axes of said tubular handle holder and said grip handle.

6. A vibroisolating handle joint structure according to claim 1, wherein said at least one pair of resilient means comprises more than one pair of resilient means which are angularly equally spaced around said handle holder.

7. A vibroisolating handle joint structure according to claim 1, wherein said at least one pair of resilient means comprises more than one pair of resilient means which are diametrically opposite to each other.

8. A vibroisolating handle joint structure according to claim 1, wherein said at least one pair of resilient means have ends facing in a circumferential direction around an axis of said handle holder and engaging surfaces of said handle holder and said cup to prevent said handle from being angularly displaced around said handle holder.

9. A vibroisolating handle joint structure according to claim 1, wherein said handle is composed of two longitudinally separate handle members jointly surrounding said handle holder.

10. A vibroisolating handle joint structure according to claim 1, wherein said handle has an air hole for introducing air therethrough into said tubular handle holder, further including a control box disposed in said tubular handle holder.

11. A vibroisolating handle joint structure according to claim 10, wherein said air hole is located adjacent to one of said second axial surfaces of said grip handle.

* * * * *